US006523824B1

(12) United States Patent
Colapinto et al.

(10) Patent No.: US 6,523,824 B1
(45) Date of Patent: Feb. 25, 2003

(54) BUSINESS MODEL ALGORITHM

(76) Inventors: Gerald P. Colapinto, 870 Encanto, Corona, CA (US) 91720; Anthony P. Colapinto, 870 Encanto, Corona, CA (US) 91720

( * ) Notice: Subject to any disclaimer, the term of this patent is extended or adjusted under 35 U.S.C. 154(b) by 0 days.

(21) Appl. No.: 09/938,393

(22) Filed: Aug. 23, 2001

(51) Int. Cl.[7] ..... G07F 17/34; A63F 9/00
(52) U.S. Cl. ..... 273/143 R; 463/20; 463/25
(58) Field of Search ..... 463/20, 12, 13, 463/25; 273/143 R, 138.1, 138.2

(56) References Cited

U.S. PATENT DOCUMENTS 5,231,568 A * 7/1993 Cohen et al. ..... 364/401
5,397,125 A * 3/1995 Adams ..... 273/138.2
5,941,772 A * 8/1999 Paige ..... 463/20

FOREIGN PATENT DOCUMENTS

GB 2208737 * 12/1989 ..... 273/138.2

* cited by examiner

*Primary Examiner*—Benjamin H. Layno
(74) *Attorney, Agent, or Firm*—Herbert C. Schulze

(57) ABSTRACT

A business model algorithm in which icons representing businesses, products, services and the like are displayed during the play of slot machines for a consideration of cash or cash credits. The icon displays, if properly aligned on a pay line, may represent an award of a product or service or a discount thereon. Thus, a business benefits by reason of a new customer and source of business contacting the business to collect the award and from the constant reminder of the business to those playing the slot machine and seeing the business icon; a casino or other owner of a slot machine benefits from the money received for playing the slot machine and the payout of a product or service which costs the owner of the slot machine nothing; the slot machine player benefits in that anything the player has won cannot be lost be being played back into the slot machine. Prior to activation of play of the slot machine, the player is offered choices for possible payouts of the slot machine including 1) being paid all in cash, 2) being paid all in products or services from the business, or 3) being paid in a combination of cash, and products or services.

1 Claim, 4 Drawing Sheets

BUSINESS MODEL ALGORITHM

CROSS REFERENCE TO RELATED PATENT APPLICATIONS

This application may be considered by some persons as related to our pending patent application for Advertising Method and Apparatus Ser. No. 09/280,797 filed Mar. 26, 1999, now pending. Additionally, Anthony P. Colapinto did previously have a patent application pending on Premium Selection Method and Apparatus filed Jul. 2, 1996, Ser. No. 08/678,404, now abandoned, which may be considered by some persons as related to the within application.

BACKGROUND OF THE INVENTION

I. Field of the Invention

This invention is in the general field of business promotion and marketing and advertising of products and services;

The invention is more particularly directed to a business promotion, marketing, and advertising business model algorithm directed to a particular class of persons who are attracted to slot machines and the like located in casinos and the like, wherein a slot machine is utilized for dispensing coupons, tokens and the like redeemable at businesses for services and products or for discounts on such services and for information concerning businesses and their services, products, or the like, in connection with business sponsored special presentations in conjunction with gaming machine operators and patrons.

II. Description of the Prior Art

Slot machines are among the most common gambling devices. There is some sort of fascination about slot machines. The result is that some people sit for hours, or even days, at slot machines, sometimes winning, but generally losing. As a result there have been numerous variations in slot machines. Almost everything conceivable has been tried with slot machines.

We are familiar with U.S. Pat. Nos. 5,231,568; 5,373,440; and 5,941,772, which at first blush may seem to be prior art as to our present invention. However, the only real similarity is that all of those patents and our present invention involve rotating or simulated rotating reels (slot machine type) mechanisms.

Our invention is a true Business Model Algorithm as was so well defined in the State Street Bank case (State Street Bank & Trust Company v. Signature Financial Group 1998 U.S. App. LEXIS 16869). In our present invention the algorithm brings together a cooperative relationship between gaming entertainment (slot machines), and businesses of all types seeking to broaden their client or customer base through education and information assisted by a machine and its operation.

Upon reading this entire Patent Application and the accompanying illustrations it will become apparent that this invention meets the test of being novel and useful and a proper business model algorithm.

It is our belief that while there is prior art as to advertising on spinning reel type machines, there is no prior art as to an algorithm designed to utilize gaming machines with the building or enhancing a business client or customer base of a broader spectrum than is reached by other means of business promotion.

As disclosed in Anthony P. Colapinto's prior patent application referred to above, he had devised a premium selection method which we believed was unique and novel. As the file wrapper in that case will show, apparently we were wrong.

In our presently pending application referred to above, we believed, and still believe, that our system revealed there is unique. We do not know how that will finally be decided.

Nonetheless we have become so completely involved with slot machines that we have recognized there is some untapped way that businesses other than casinos can build a customer base by using slot machines in unique ways.

We believe there is no prior art to the business promotion model and algorithm disclosed in this patent application.

SUMMARY OF THE INVENTION

We have studied slot machines and the people who play them for long periods of time. We have interviewed casino patrons and casino personnel.

We have discovered that there are those who play slot machines with the honest expectation that they will win huge amounts of money. There are others who expect to lose, but are entertained by the spinning wheels and the excitement they find in the bare possibility they may win. Still others find playing slot machines an exciting interlude in an otherwise boring existence. Almost universally the person who plays slot machines will lose.

Generally, a slot machine player will win a few dollars after a period of losing play. The slot machine player will then continue to play mixing the winnings with any other funds on hand. This will be repeated time after time with the average slot machine addict until he or she loses all initial funds as well as all he or she has won at various times. A very beneficial feature of our business model algorithm is that a slot machine player will be virtually forced to save something from his or her occasional winnings.

Some of these machines actually employ reels which spin, and some of the machines produce an image which appears to be a spinning reel, but is in fact an electronic image producing device.

We have now conceived and developed a method and apparatus wherein some, or all of the pictures upon the reels or simulated reels are pictures of various products, or businesses or services and/or descriptive information or the like rather than meaningless symbols. With our new invention we can attract and hold the attention of persons for long periods of time during which time periods informational and other messages can be repeatedly displayed without losing the attention of those participating or watching. Thus, this is an excellent way to display information concerning a business and the like.

Our new business algorithm also is a new way for businesses and gaming establishments to increase business, widen their customer bases, and increase profits.

Our new invention includes incentives for those playing the slot machines utilizing the methods of this new model to purchase the products and services being displayed and provides increased revenues for the casino or other gaming establishment. The slot machine is played in the customary way with players inserting coins or tokens purchased from the casino and without the necessity of any special cards, or other equipment or conditions.

In one alternate method of playing slot machines using our new method and algorithm the player may select to play exclusively for service and product awards, or exclusively for cash payout, or for a mixture of the two.

When playing for service and product awards alone or in combination with cash awards the slot machine player is virtually forced to save something and not lose everything. Most slot machine players will take any winnings and continue to play the winnings as well as their initial cash, thus ending a session with nothing. In our new system, the product and service awards cannot be played back into the machines. It is necessary to use cash or cash credits in order to activate the slot machines. Thus when one wins a product or service award he or she is virtually forced to leave the casino or the like with something of value.

It is object of this invention to provide a customary slot machine located within a gaming establishment or the like wherein the reels or simulated reels display icons, pictures and other depictions for products or services in addition to the usual icons utilized for cash payout;

Another object of this invention is to provide such machines wherein various combinations of pictures displayed will align on a pay line and provide options of cash payout or an increased value by selecting the product or service depicted at prices which result in greater value to the person playing the slot machine than could be obtained by the otherwise available cash payout;

Another object of this invention is to provide incentives for those playing slot machines to visit particular commercial establishments.

The foregoing and other objects and advantages of this invention will become apparent to those skilled in the art upon reading the description of a preferred embodiment which follows in conjunction with a review of the appended drawings.

DESCRIPTION OF A PREFERRED EMBODIMENT

Figure 1:
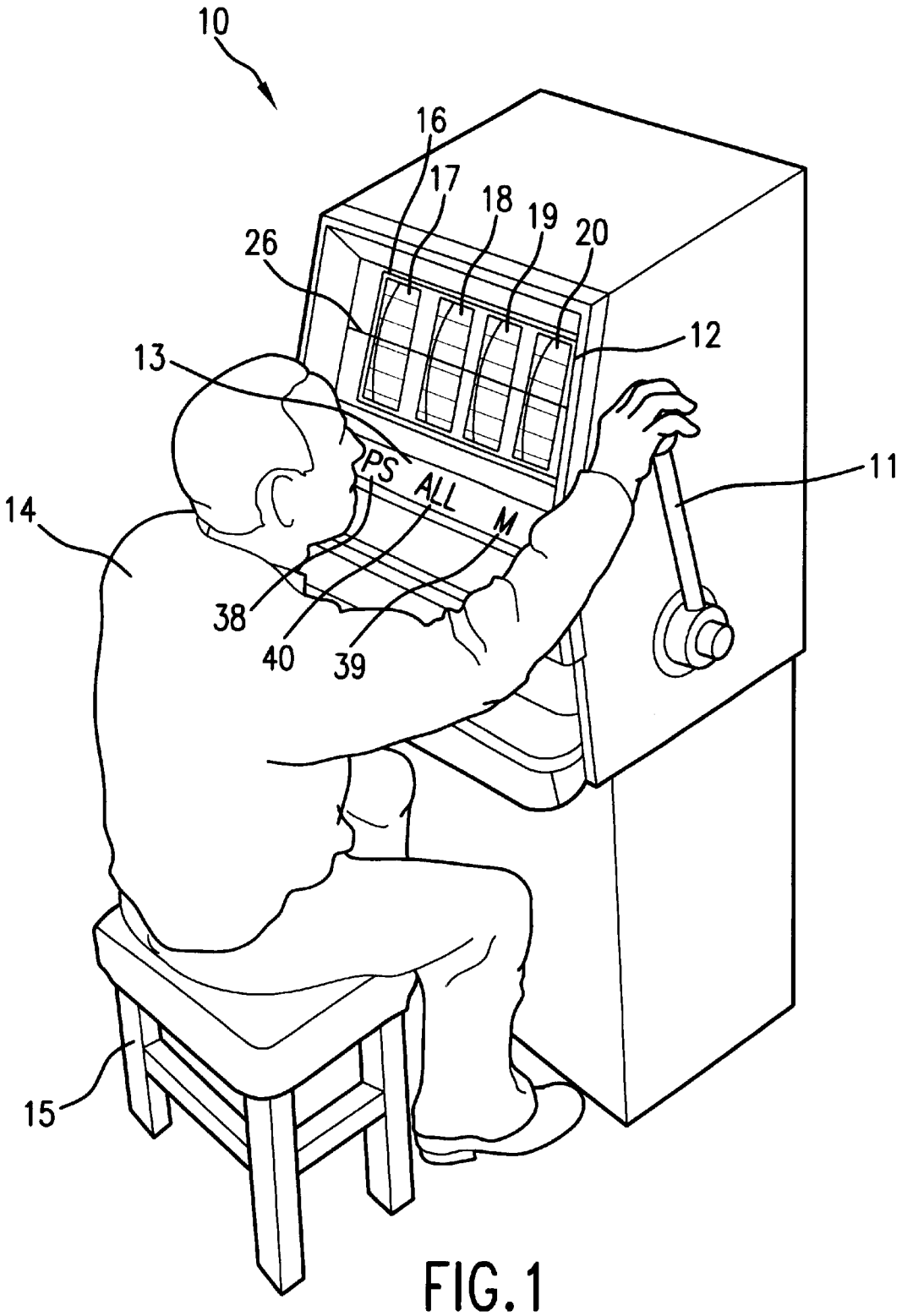
FIG. 1 is a perspective of a slot machine suitable to practice the method of this invention.

The elements of this invention which bear reference numerals are:

Numeral Description of Element
10 reel type machine (slot machine)
11 activating handle
12 activating button
13 touch screen
14 person
15 chair
16 window frame
17 window
18 window
19 window
20 window
21 reel
22 reel
23 reel
24 reel
25 four symbols on pay line
26 pay line
27 motel symbol on reel
28 canoe symbol on reel
29 automobile symbol on reel
30 attorney symbol on reel
31 clothing symbol on reel
32 restaurant symbol on reel
33 golf symbol on reel
34 cherries symbol on reel
35 star symbol on reel
36 coupon
37 token
38 symbol PS
39 symbol $
40 symbol ALL As a preliminary or first step in our new business model algorithm it is necessary that an agreement be reached between a business and a casino or the like (this is not to imply that a casino is not a business, but to distinguish a casino or the like as a particular type business which operates slot machines). The system set forth in this patent application will also be applicable to any place a slot machine may be located. Slot machines are found in various business establishments such as markets, fraternal lodges, and the like.

The agreement which must be reached will include a price, if any, to be paid by a business to have icons of the business and its products or services placed on the slot machine reels, the percentage of payout, and other details as will be known to those skilled in the art.

In some cases, such as supermarkets, our new invention can be practiced without an agreement between two different organizations. A supermarket, for example, might operate our system utilizing some, or all, of its products as the basis for pay out coupons or tokens.

After an agreement and the terms are reached, whether between two or more organizations or merely within a single organization such as a supermarket, the necessary icons will be placed appropriately on the reels, after which the newly programmed machines can be operated.

A slot machine 10 being operated by a person 14 is shown in FIG. 1. Many persons who play slot machines do so for long periods of time, and thus sit on a chair or stool 15. It is not uncommon for those who play slot machines regularly to reserve a machine to which they have become attached when taking time from playing the machine for a meal or to use a rest room. Casino personnel frequently will reserve a machine for such persons. Many slot machines have a handle 11 for activation of each play and an activation button 12 for those who cannot operate the handle or prefer to merely touch a button. Some machines will also have a touch screen 13. Where the machine has a touch screen there are even special enhancements in using our new method. The touch screen 13 in FIG. 1 is displaying three symbols. Symbols PS, $, and ALL are meant to indicate that the player may select, by touching the screen, to play for products and services (PS), or for cash ($), or for a mixture of products and services and cash payout possibilities (ALL). This is a simple matter of programing the machine to respond to the touch on the screen as will be known to those skilled in the art. I have shown four reels 20, 21, 22, and 23. Each reel is seen through a window 16, 17, 18, and 19. The alignment of symbols or the like on a pay line as viewed through the four windows determine whether the player receives a service or product award or discount coupon or token or payout of coins or the like.

Typical slot machines will have a variety of different icons, generally of no particular significance except as values may be assigned to them to indicate the payout. In the case of our presently pending application referred to above, symbols may include information about, and illustrations of, businesses, products and services.

Our present invention is completely different from the customary methods of programming and operating slot machines in that in utilizing our method or model or algorithm particular meaningful and significant symbols are utilized to direct the ordinary slot machine user to particular merchants, products, services, and the like. At the same time, the processes of our invention can enhance the use and profitability of casinos and the like.

Utilizing our system a merchant, for example, can attract new customers at virtually no cost. The average merchant or other business must spend large sums of money in various forms of advertising and the like to attract new customers. Our method and business model algorithm can attract new customers at virtually no cost.

A business of almost any nature and located in almost any place can arrange with a casino or the like to have a slot machine payout consist of a coupon 36 or a token 37 or the like which may be exchanged for a service or product of a business or for a discount on such service or product:

1) An example would be a coupon or token allowing for half price for a round of golf at a golf club. The round of golf could even be specified at a day and time when the golf course is normally not heavily used. In this way, the winner at the slot machine gets something of real value, the round of golf, and the golf course will not lose since this a slack time. The golf course could even receive extra income since the winner of the round of golf will probably buy a meal, golf balls, or other items while at the golfing facility;
2) Another example would be a sporting goods store. A winner of a coupon or token could be entitled to a substantial discount, for example, a two hundred fifty dollar discount on a one thousand dollar canoe;
3) Another example would be an attorney. A winner of a coupon or token could receive a will and an estate planning consultation for which the attorney normally charged at the rate of two hundred fifty dollars per hour for only seventy-five dollars per hour. This could be at a time when the attorney knew he would normally not be productive.

In each of the above listed examples, and in virtually every situation in using our system everyone wins. The slot machine player has received a payout of value which he cannot feed back into the slot machine thus assuring that he will not leave the casino or the like empty handed; The business has received a new customer and made a some profit on the first sale to the new customer and may have secured a long time new customer; the casino or the like has received money for the plays made by the person playing the slot machine, and possibly a fee from the business for putting the icons on the reels. Any business can well afford to pay a fee to have icons on the reels as they are a constant reminder of the business to everyone who plays the machine whether winning or not.

Figure 2:
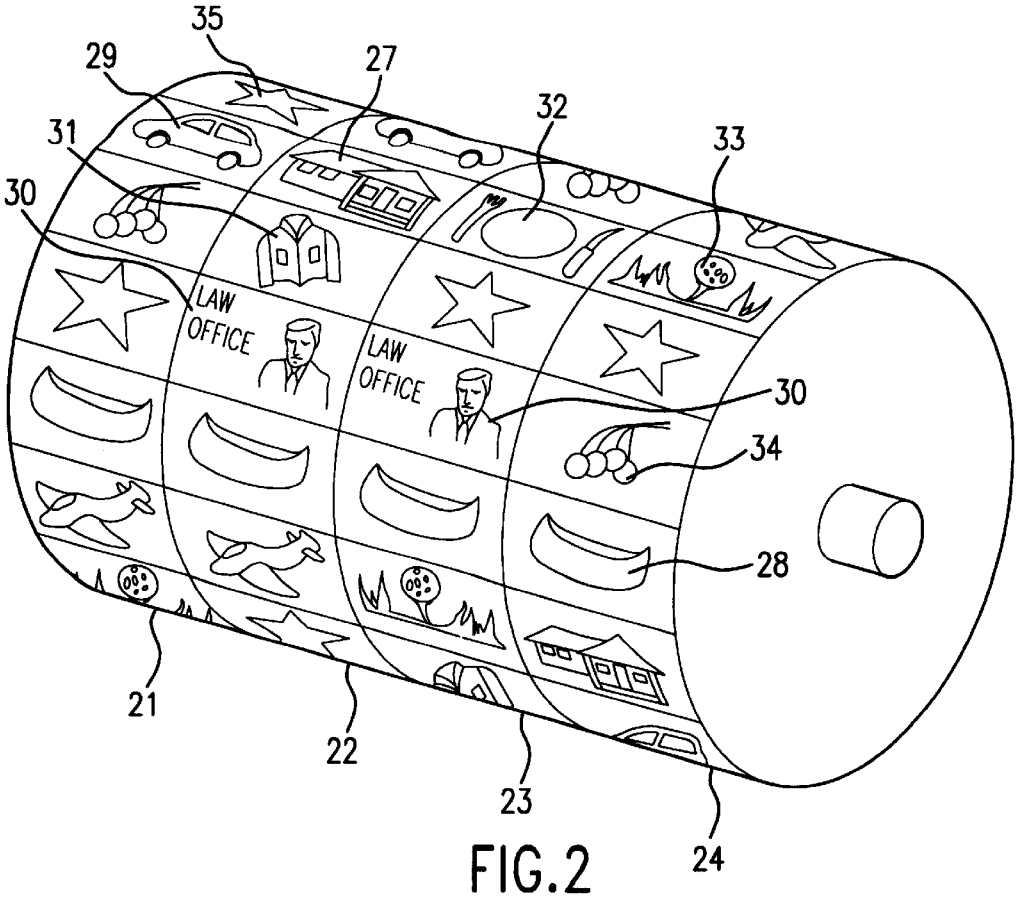
FIG. 2 is an enlarged perspective of the reels utilized in the apparatus of FIG. 1.
Figure 3:
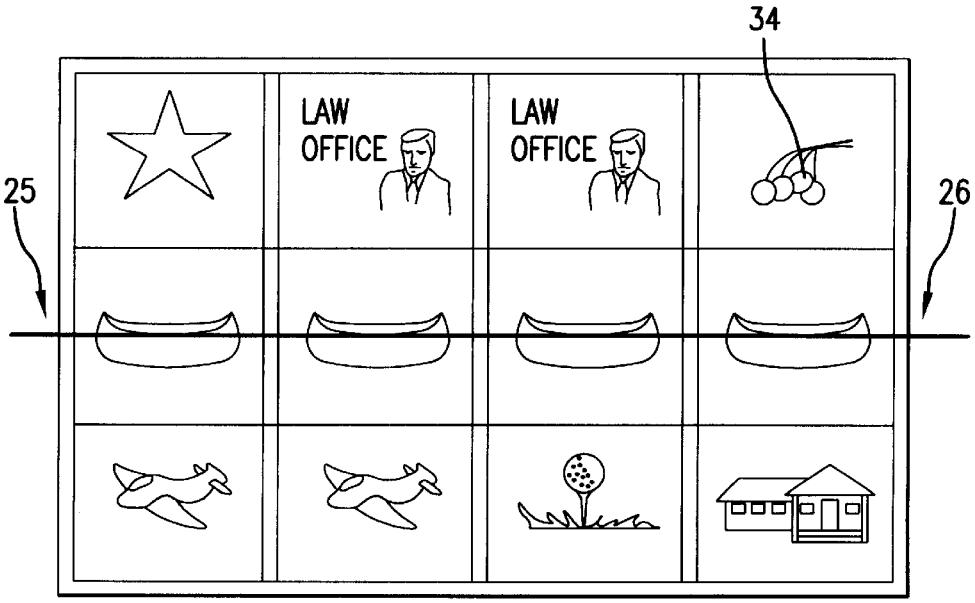
FIG. 3 is an enlarged view of the window portion of the machine of FIG. 1 shown with symbols as in the view of the reels in FIG. 2.

FIGS. 2 shows four reels 21, 22, 23, and 24 removed from a slot machine with various icons shown, and FIG. 3 shows the reels and symbols behind the window frame 16 and windows 17, 18, 19, and 20. Some of the icons are motel 27, canoe 28, automobile 29, attorney 30, clothing 31, restaurant 32, golf 33, and cherries 34 and stars 35. Cherries and stars are common icons appearing on slot machines having no particular significance except they may indicate a payout in certain combinations and alignments.

Figure 4:
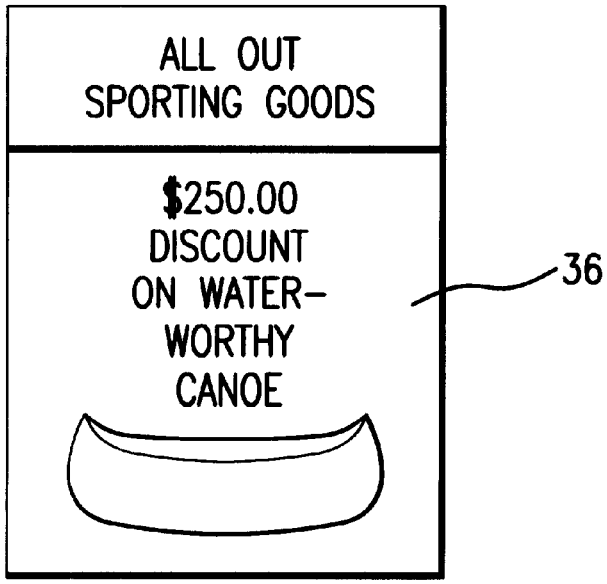
FIG. 4 is a coupon which can be dispensed by the slot machine.
Figure 5:
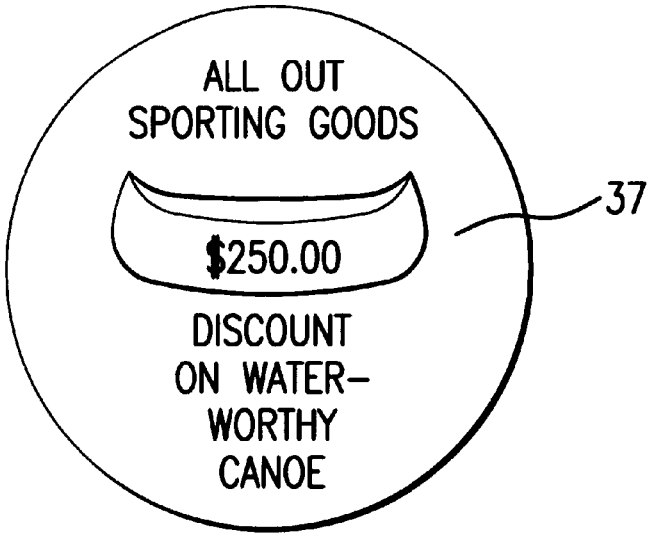
FIG. 5 is a token which can be dispensed by the slot machine.

FIGS. 4 and 5 show examples of a winning coupon 36 and token 37 which can be dispensed by means known to those skilled in the art or merely awarded by casino personnel upon a slot machine displaying a winning combination such as the canoe discount indicated in FIGS. 2, 3, 4, and 5.

FIG. 3 shows four identical icons lined up on a pay line. In this case the four icons are four canoes.

In use, the person utilizing the machine will select PS, $, or ALL on the touch screen if that option is available. Coins will then be inserted in the usual manner, or credits may be played if that option is available on the particular slot machine being used (all of these items and other options on slot machines are known to those skilled in the art). The reels spin in the usual manner and come rest in the usual manner. The programming of the reels and their alignments will be customary.

When there is a proper alignment of a winning combination of icons in utilizing our invention, the payout may be in cash, in coupons or tokens, or the like as will be understood by those skilled in the art. It will be perfectly feasible for a product or service payout to be accompanied by a cash payout. For example, a payout might be a pair of airline tickets to Hawaii accompanied by five hundred dollars in cash for expense money.

There can be audible and visual accompaniments to the slot machine play under our method, model and algorithm. Maps can be displayed and printed, instructions may be included. For example in our example of the canoe discount above, there could be an accompanying map and/or audible information concerning excellent canoeing streams, hotel and dining accommodations along the way, etc.

Figure 6:
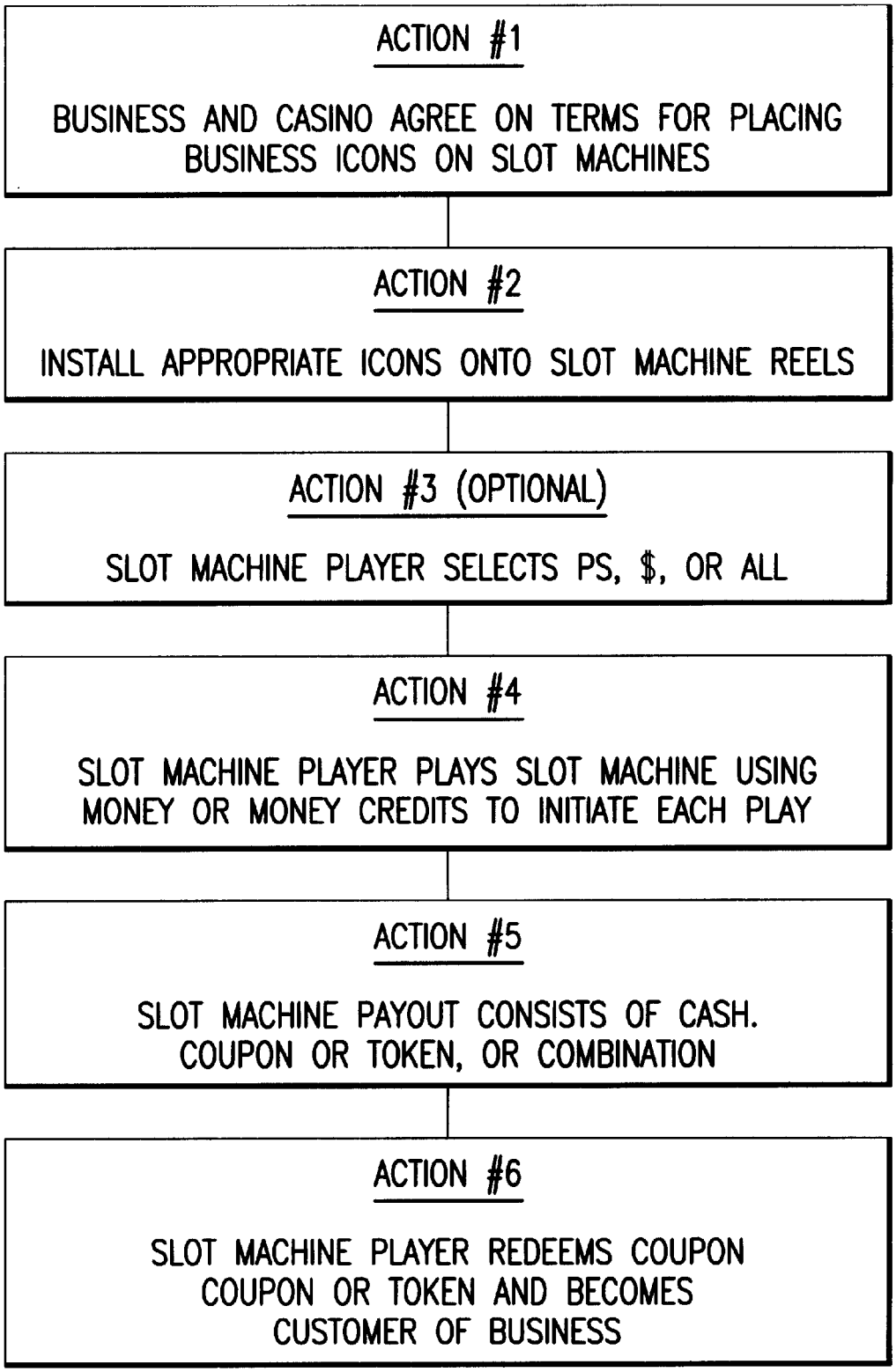
FIG. 6 is a block diagram indicating the various steps of this new business model algorithm.

FIG. 6 is a block diagram showing the steps employed in this method, model and algorithm.

It can be seen that the income opportunities for businesses and casinos are virtually unlimited utilizing our systems. All manner of services and products can get excellent, continual and economical exposure to a huge and extremely diverse segment of the population.

While the embodiments of this invention shown and described are fully capable of achieving the objects and advantages desired, it is to be understood that such embodiments are shown for purposes of illustration only and not for purposes of limitation.

We claim:

1. A business model algorithm for advertising a business, product, or service and attracting customers to that business, product, or service comprising the steps of: obtaining an agreement between a business, product owner, or service and a casino having slot machines whereby icons representing the business, product, or service are displayed on portions of slot machine reels; prior to activation of a play of the slot machine offering choices for possible payouts of the slot machine including 1) all cash, 2) all products or services from the business, product owner or service, or 3) a combination of cash, and products or services; inserting a coin or token or credit account into the slot machine; activating the slot machine through a cycle of play; and awarding the selected payout when a payout is indicated at the conclusion of the cycle of play.

* * * * *